United States Patent [19]

Bernard

[11] Patent Number: 4,961,297

[45] Date of Patent: Oct. 9, 1990

[54] TRANSPORTABLE WEATHER RESISTANT BUILDING ENCLOSURE

[76] Inventor: Samuel D. Bernard, 3303 Dolson Court, Mississauga, Ontario, Canada, L5L 4R5

[21] Appl. No.: 287,439

[22] Filed: Dec. 21, 1988

[30] Foreign Application Priority Data

Dec. 7, 1988 [CA] Canada ..... 577170

[51] Int. Cl.[5] ..... E04B 7/00

[52] U.S. Cl. ..... 52/93; 52/806; 52/588

[58] Field of Search ..... 52/306, 309.1, 93, 461, 52/463, 467, 468, 90, 806, 588

[56] References Cited

U.S. PATENT DOCUMENTS

| | | | |
|---|---|---|---|
| 645,890 | 3/1900 | Conrad . | |
| 1,168,942 | 1/1916 | Irwin | 52/467 X |
| 1,363,407 | 12/1920 | Goudie | 52/90 |
| 1,648,724 | 11/1927 | Dakin . | |
| 2,706,538 | 4/1955 | Schumann | 52/90 X |
| 2,781,109 | 2/1957 | Memmler | 52/463 |
| 2,936,862 | 5/1960 | Cvikl | 52/90 X |
| 3,233,617 | 11/1961 | Stern | 135/1 |
| 3,708,928 | 1/1973 | Gaspers | 52/90 |
| 3,805,816 | 4/1974 | Nolte | 135/1 R |
| 4,033,367 | 7/1977 | Johnston | 135/8 |
| 4,128,973 | 12/1978 | Robinson | 52/2 |
| 4,229,914 | 10/1980 | Lucas | 52/63 |
| 4,443,987 | 4/1984 | Erb | 52/309.1 |

FOREIGN PATENT DOCUMENTS

| | | | |
|---|---|---|---|
| 203686 | 5/1959 | Austria | 52/467 |
| 62625 | 8/1944 | Denmark | 52/463 |
| 2259006 | 6/1974 | Fed. Rep. of Germany | 52/309.1 |
| 2136591 | 7/1978 | Fed. Rep. of Germany | 52/306 |
| 2840169 | 4/1979 | Fed. Rep. of Germany | 52/309.1 |
| 2824759 | 12/1979 | Fed. Rep. of Germany | 52/306 |

OTHER PUBLICATIONS

Lexcan Thermoclear Sheet Brochure, GE-5/87.

Installations for Producing PP-PEHD-PC-PMMA Cellular Profile Union-Undated.

*Primary Examiner*—Richard E. Chilcot, Jr.

*Assistant Examiner*—Jerrold D. Johnson

*Attorney, Agent, or Firm*—Rogers, Bereskin & Parr

[57] ABSTRACT

A method of erecting a weather resistant transportable building enclosure is disclosed. The method includes the steps of assembling a plurality of elements to form a roof ridge, assembling a plurality of panel supporting elements to form girders of a predetermined length extending laterally from the roof ridge and pivotally attaching girders to the roof ridge. The next step is to raise the roof ridge a predetermined amount and to further attach the girders to the roof ridge to rotationally fix the pivotal attachment. At this stage a roof skeleton has been formed. Then panels can be attached onto said roof skeleton to form a load supporting roof. A final step is to simultaneously raise the roof, attach a plurality of elements to form side wall columns, and secure a plurality of panels onto the columns to form side walls for the enclosure. The enclosure is comprised of an internal rigid load supporting framework and an external load supporting surface. The external surface is made from rigid transparent building panels which transmit solar light and heat into the building enclosure. Each panel has a width greater than its height and is supported by the rigid framework along its side edges. The panels also have openings in their lower edge to flexibly retain the adjacent lower panel therein.

24 Claims, 9 Drawing Sheets

TRANSPORTABLE WEATHER RESISTANT BUILDING ENCLOSURE

BACKGROUND OF THE INVENTION

This invention relates to a weather resistant building enclosure and in particular to a building of the type used for protecting against inclement weather. Such building enclosures have various purposes, such as coverings for residential building sites, pool enclosures, animal exercise barns, tennis court enclosures and the like.

In the past, attempts have been made to design temporary building structures which are suitable among other things, to temporarily enclose construction sites to prevent the effects of inclement weather. An example of such a building enclosure is that disclosed in U.S. Pat. No. 3,233,617 in the name of H. Stern, dated Feb. 8, 1966. This patent discloses an interior frame which is covered with a flexible covering made from canvas, plastic film or the like. The drawings in this patent disclose a sheet film completely covering the skeleton; however the disclosure suggests that the covering may also be made from interconnectable panels. No disclosure is made of such panels, or their structure nor how such panels might be interconnected or secured to the skeletal frame.

Further, this patent teaches the use of a plurality of straight plank base members defining an outer perimeter of a rectangular base for the enclosure. The skeleton framework is secured to the base and the base is secured to the ground. Then, a covering is disposed over this skeleton framework.

There are several disadvantages to the temporary enclosure taught by this prior patent. Firstly, where the covering is flexible, it may be easily ripped especially where the covering is used over a construction site. In addition, the flexible covering will tend to bow inwardly upon being loaded from above by, for example, snow, rain or the like. This will cause the flexible covering to deform and may eventually lead to failure of the outer covering. Further, the cover could easily be ripped in high winds such as may be associated with a winter storm. In addition, the structure relies upon being secured to a base plank which is in turn secured to the ground for stability against wind. This makes the structure difficult to disengage and move in the event that a particular building is completed and the enclosure is to be moved elsewhere.

SUMMARY OF THE INVENTION

What is desired is a temporary building enclosure which overcomes these disadvantages. Preferrably the enclosure will be of the type having rigid structural load bearing panel members which are releasably secured to a rigid modular skeletal frame and which transmit solar light and heat for passive lighting and heating of the enclosure. Further, the enclosure would preferrably be self sufficient and capable of being lifted, for example by a crane, from building site to building site. In addition, such an enclosure would preferrably be easily assembled with a minimum of labour and expense.

Therefore, there is provided according to the present invention:

A weather resistant building enclosure comprising an internal rigid load supporting framework comprising a plurality of columns, roof girders supported by said columns and beams, extending between adjacent of said columns and said roof girders, and an external load supporting surface comprised of a plurality of rigid transparent building panels, each panel having an inner layer and outer layer and a plurality of stiffening webs running between said inner and outer layers and transmitting solar light and heat into said building enclosure, each panel having two side edges, a lower edge and an upper edge, said panel having a width greater than its height, and being supported by said rigid framework along its side edges, and further having an opening in the lower edge of the panel to flexibly retain the next adjacent lower panel therein.

DETAIL DESCRIPTION OF THE PREFERRED EMBODIMENT

Figure 1:
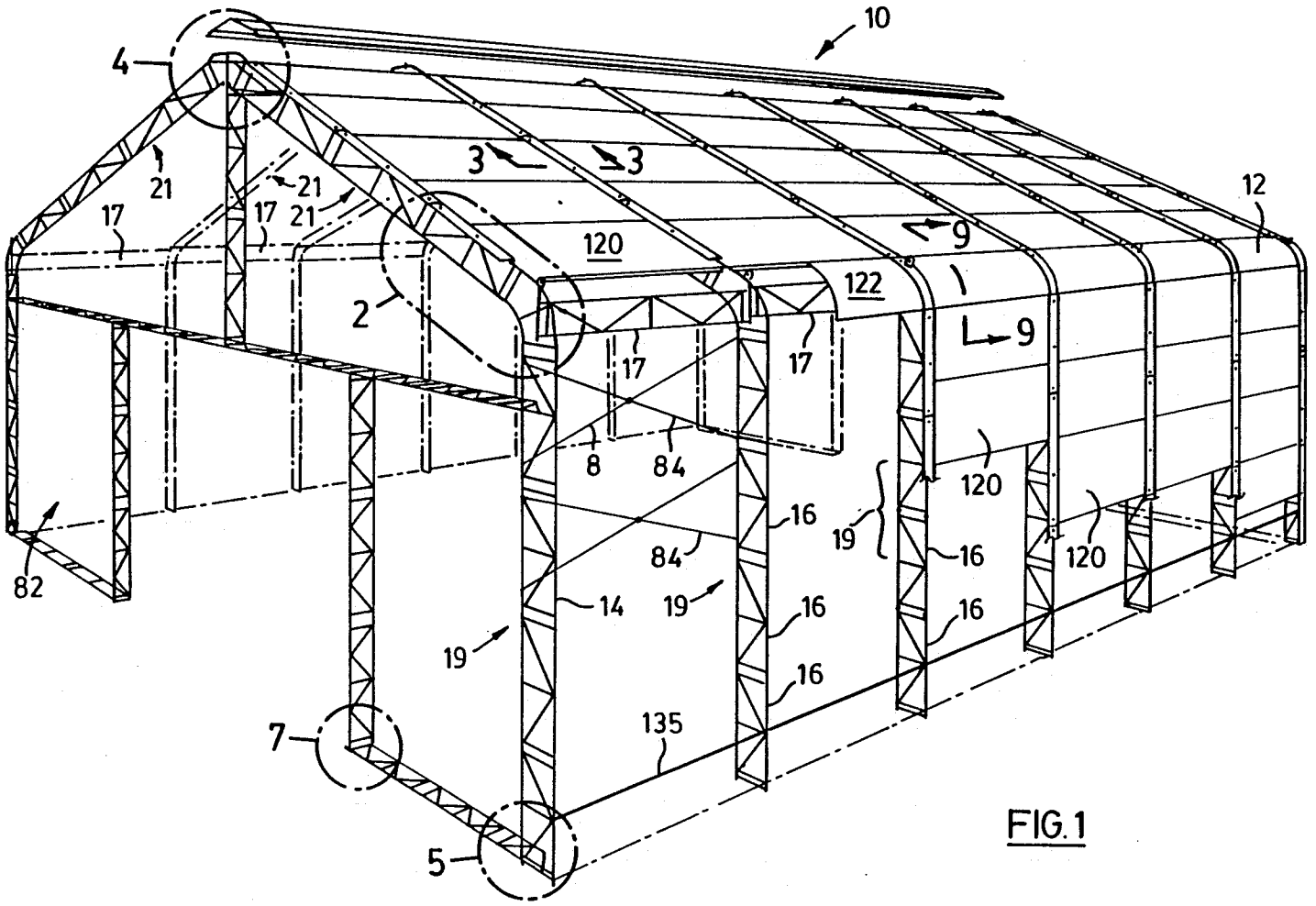
FIG. 1 is a perspective view of a building enclosure according to the present invention.

A building enclosure 10 according to the present invention is shown in FIG. 1. The building enclosure 10 is formed from a number of elements, including outside skin 12 which is secured to an internal skeleton 14 in a manner described below.

Figures 2, 3:
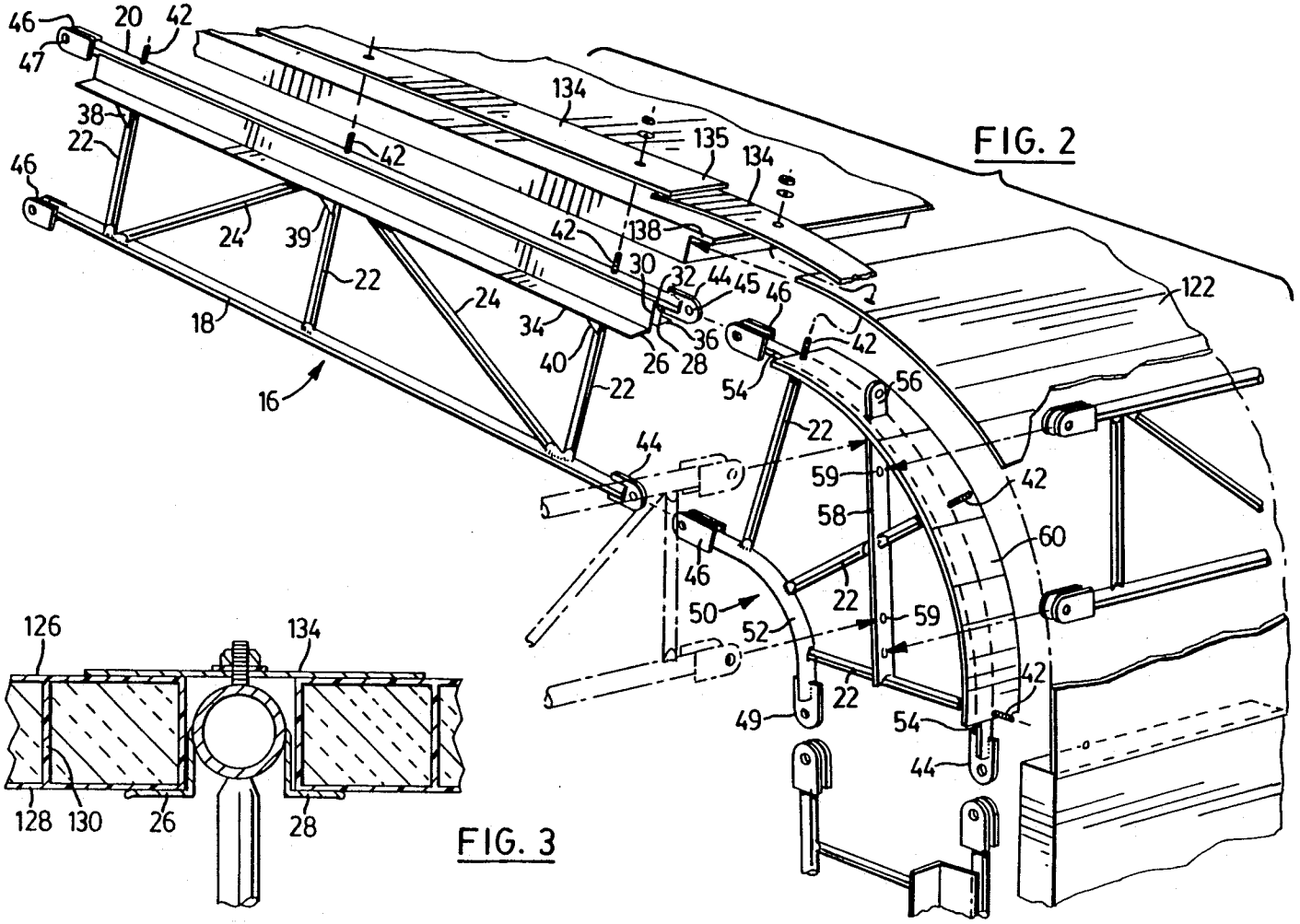
FIG. 2 is a close up exploded view of the area denoted as 2 in FIG. 1.
FIG. 3 is a cross-section along the line 3—3 of FIG. 1.

The internal skeleton 14 is comprised of, among other things a number of identical panel supporting elements, indicated generally as 16. Referring to FIG. 2, one such element 16 is shown. The element 16 is comprised of a lower bar 18 and an upper bar 20 which are attached by means of a number of cross braces 22 and angle braces 24. The braces 22, 24 may be attached to the upper and lower bars 18, 20 by any suitable means such as welding or the like.

Also shown in FIG. 2 are a pair of right angle channels 26, 28 attached to the element 16. The right angle channels 26, 28 have generally vertical legs 30, 32 and generally horizontal legs 34, 36. The generally vertical legs are preferrably spot welded to the upper bar 20, while the generally horizontal legs 34, 36 are preferrably supported by means of reinforcing angles 38, 39 and 40 between the horizontal legs 34, 36 and the cross braces 22 as shown.

Also shown are threaded studs 42 which extend outwardly from the upper bar 20. Further, at the right hand end of each of the upper and lower bars 18, 20 are shown male attaching members 44, while at the left hand end of each are shown a female attaching members 46. The male attaching members 44 are comprised of a flat plate having a locking hole 45 therethrough, while the female attaching members 46 are comprised of a pair of parallel and opposed flat plates 45 having registering locking holes 47 therethrough. The attaching members 44, 46 can be secured to the upper and lower bars 18, 20 by any suitable means such as welding or the like.

Also shown in FIG. 2 is a corner or eave joint member 50. The eave joint member 50 is formed from an inner bent bar 52 and an outer bent bar 54 which are attached by three cross braces 22. Again, a female attaching member 46 is provided at the left hand end of each of the inner and outer bars 52, 54 and a male attaching member 44 is provided at the right hand end. It will be noted from FIG. 2 that the right hand end is now facing downwardly as a result of the curve in the inner and outer bent bars 52, 54. Again, a number of threaded studs 42 are provided and as in respect of element 16 the threaded studs 42 are located opposite the cross braces 22 for additional strength. In addition, there is shown on eave joint member 50 a lifting point 56 which in essence is an extension of a flat bar 58 attached to cross braces 22 and outer bent bar 54 as shown. The flat bar has a plurality of locking holes 59 formed therein. Again, all of the components which make up the eave joint 50 are preferrably welded together. Also attached to the outer bent bar 54 is a curved plate 60.

Figure 4:
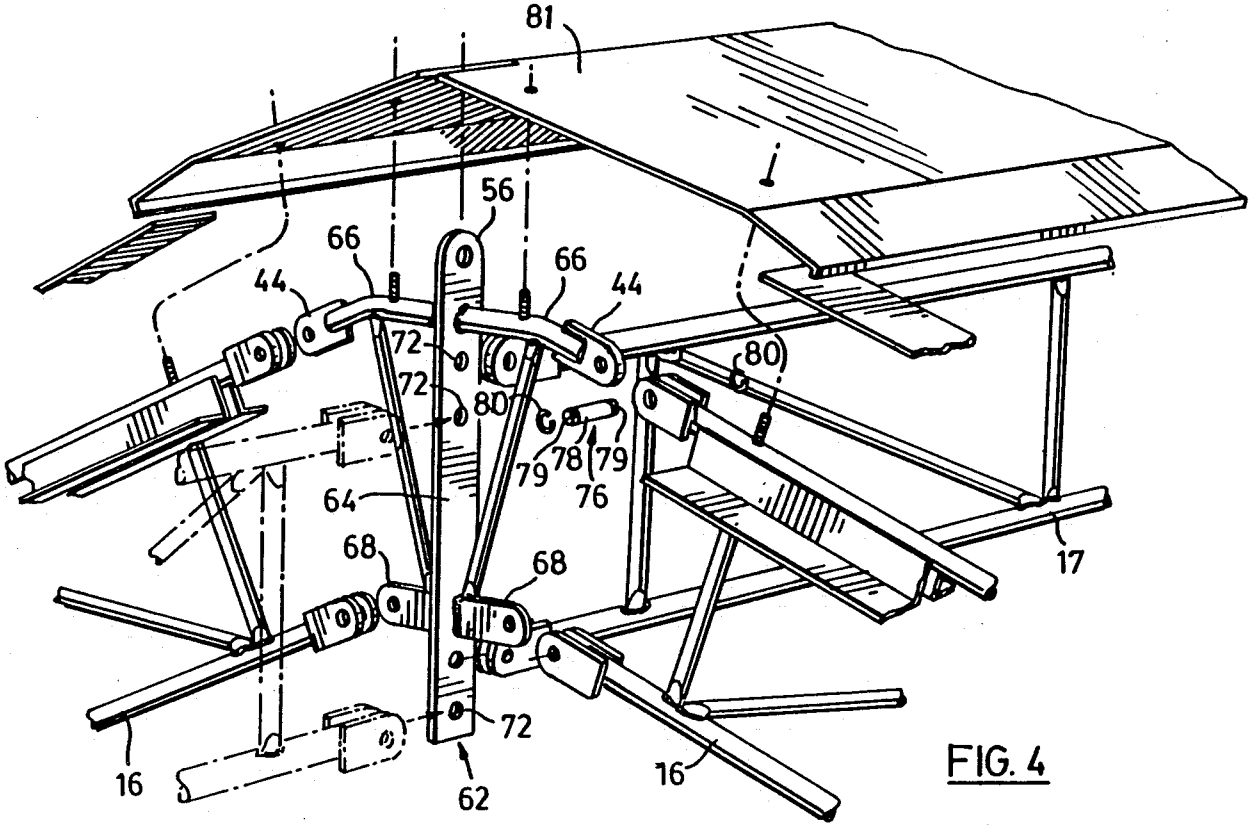
FIG. 4 is an end view in exploded perspective of the area depicted as 4 in FIG. 1.

In FIG. 4, a ridge joint member is indicated generally at 62. The ridge joint member 62 is comprised of a central vertically oriented flat bar 64 which has a pair of upper arms 66 and a pair of lower arms 68 attached as shown. An angle brace 70 runs between the upper arms 66 and the lower arms 68 as shown. A plurality of locking holes 72 are also shown. Again, the components of the ridge joint member 62 are preferrably welded together. The ends of the upper and lower arms 66, 68 are provided with male attachment members 44 as shown. In addition, a lifting point 56 is provided extending upwardly and forming the upper end of the flat bar 64.

It can now be appreciated how the internal skeleton 14 of the present invention may be assembled. Referring to FIG. 4, there are shown two elements 16 of the internal skeleton 14. The female attaching members of the elements 16 may be attached to the male attaching members 44 by means of a clip 76 as shown. The clip 76 may comprise a pin 78, having a groove 79 at either end, and two lock rings 80 which can be releasably secured in the groove 79. In this manner a secure attachment can be effected quickly and easily between the male and female attaching members. It will be appreciated that while the foregoing description relates to one connection, clips 76 can be used in all cases where elements 16 of the internal skeleton 14 are connected to other elements such as members 50, 62. For durability, the clips 76 are preferrably formed from stainless steel.

Also shown in FIG. 4 is a ridge cap 80 which forms the upper most portion of the outside skin 12. The ridge cap 80 is secured onto the threaded studs by means of washers and nuts (not shown).

Turning again to FIG. 1, it can be seen that the building enclosure 10 can be formed from a skeleton 14 of substantially identical panel supporting elements 16 as indicated. In FIG. 1, the outside columns 19 and the inclined roof members or girders 21 are formed from identical elements 16 joined at the ends by clips 76. There are also a number of support elements 17 as indicated in FIG. 1 which while similar to elements 16 are somewhat different. An example of a portion of a element 17 is illustrated in FIG. 4. As can be seen, the elements 17 are somewhat simpler in that they do not have the right angle channels 26, 28 nor the threaded studs 42. The elements 17 are used between the columns 19 at the eaves and along the ridge between the girders 21 of the building enclosure 10 and form in essence beams As can be seen in FIG. 2, the elements 17 have female ends 46 which can be attached around flat bar 58 of the eave joint element 50. Similarly, along the ridge, the elements 17 can be placed on either side of the flat bar 62 and can be secured by means of pins 76. Both ends of elements 17 would have female attaching members 46.

Figures 5, 6, 6A:
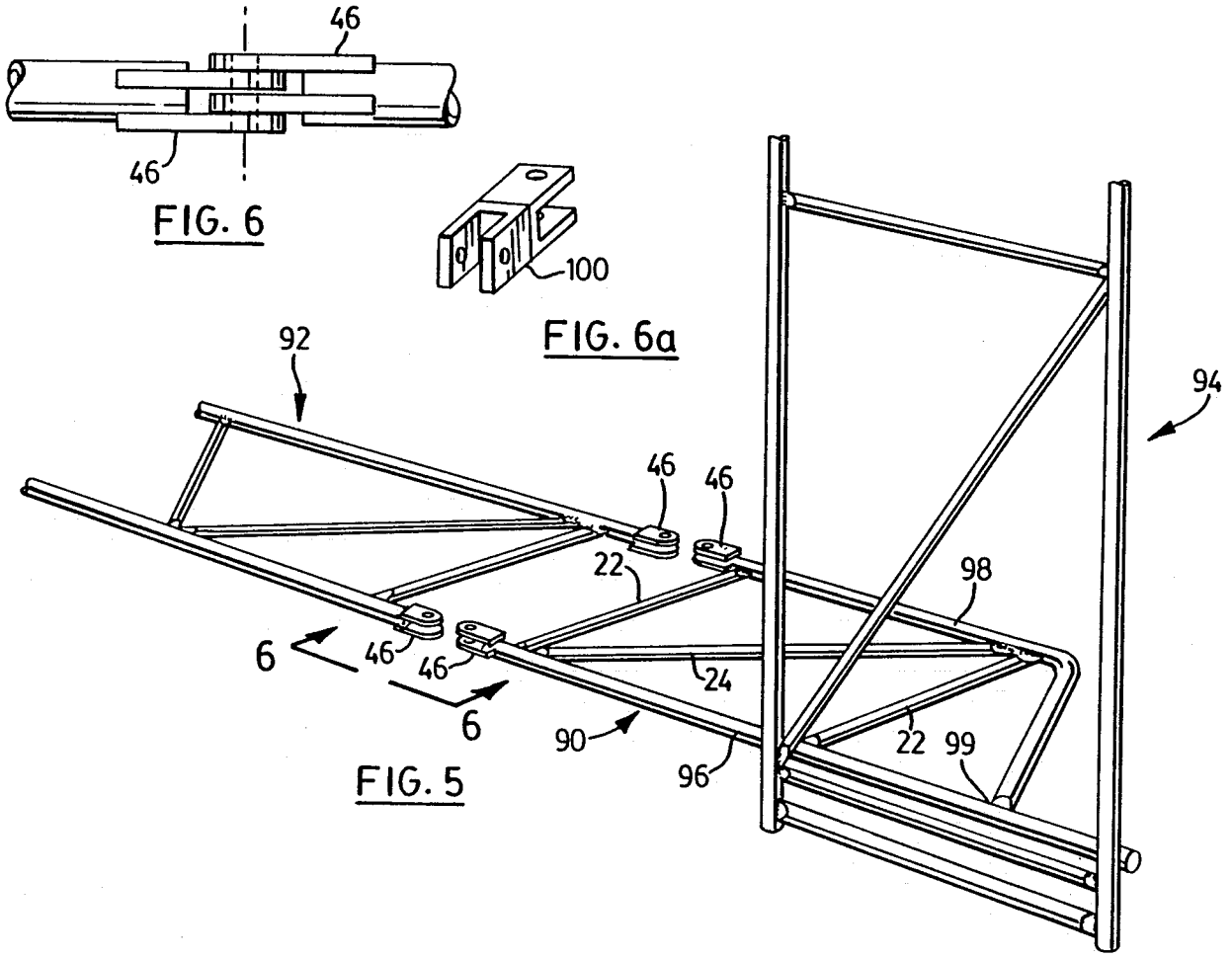
FIG. 5 is a perspective view of the area denoted as 5 in FIG. 1.
FIG. 6 is a view along the line 6—6 of FIG. 5, with the joint closed.
FIG. 6*a* is an enlarged view of a clip.

In addition to the elements 16 and 17, somewhat specialized building elements are required to form the end walls 82 of the building enclosure 10. Referring to FIG. 5, there is shown a element 90 which allows a horizontal portion 92 to be attached to a vertical portion 94. The element 90 has one straight rod 96 and a bent rod 98. The bent rod 98 starts parallel to straight rod 96 and then bends and joins straight rod 96 at 99. An angle brace 24 and pair of cross braces 22 are also provided as shown. A joint is formed between the horizontal portion and a vertical portion at one end of the element 90 by interlocking the mating female attaching members 46 as shown in FIG. 6. A pin 78 as described above would be appropriate. At the opposite end of the element 90, the vertical portion could be secured to the straight rod 96 by means of opposed U-shaped joint pieces 100 as shown in FIG. 6*a*.

Figure 8:
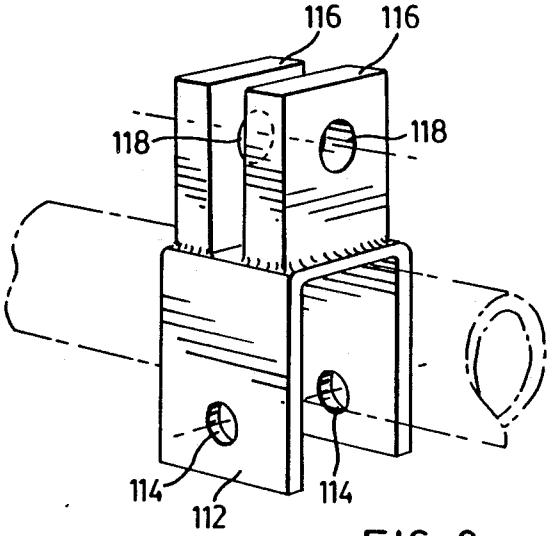
FIG. 8 is a detail view of a portion of FIG. 7.
Figure 7:
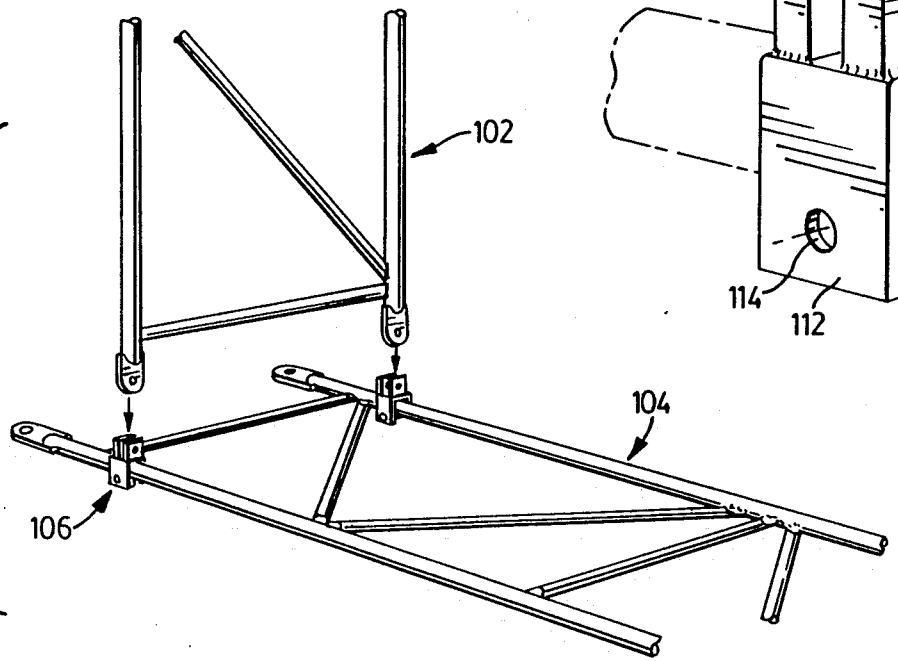
FIG. 7 is a view of the area denoted as 7 in FIG. 1.

FIG. 7 shows another attachment utilized in the end wall of the building enclosure 10. In this case, a vertical member 102 is abutting a horizontal member 104. A joint piece 106 can be used to secure the attachment. The joint piece 106 is illustrated in FIG. 8 and consists of a generally U-shaped body 112 at one end, with a pair of registering locking holes 114 therethrough. Attached to the cross portion of the U at the other end of the body is a pair of upstanding plates 116 with registering locking holes 118. In this manner the connection between the male attachment member 44 and the horizontal portion of the end wall can be made as shown in FIG. 7.

The skeleton 14 is preferrably made from tensile steel (8 gauge) with a strength calculation of 50,000 lb./ sq. in. Outside dimensions of the upper and lower bars 18, 20, for example, are 1.65 in. The angle braces 24 preferrably run at 45 degrees in a zig-zag pattern between the upper and lower bars 18, 20 and are preferrably of 1in. 10 gauge steel tubing. These braces 24 alternately act in tension and compression to accommodate stresses from external loading. The preferred distance between the upper and lower bars 18, 20 is 24 in. The male and female attachment members 44, 46 are preferrably formed from 1 in. steel plate lugs. The elements 16, 17 preferrably measure 6 ft. in length.

It can now be appreciated how the outer skin 12 is formed The outer skin 12 consists of a plurality of panels 120 which form the bulk of the roof and the side walls. Special panels 122 curve around the eaves, and the ridge cap 80 completes the roof.

Figure 12:
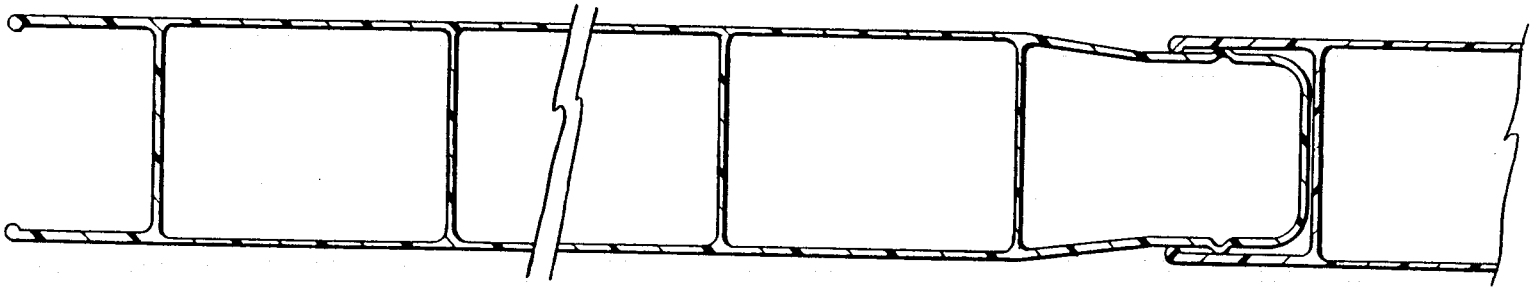
FIG. 12 is a detail view of two panels according to the present invention showing their interconnection.

Turning to FIGS. 2 and 3, the method of attachment of the panels can be appreciated. In particular, the panels are constructed with an outer surface 126, an inner surface 128 and a number of corrugations extending therebetween indicated as 130. The panels 120 fit within the right angle channels 26, 28 of the building elements 16. Seam covers 134 are used to secure the panels 120 in the channels 26, 28 and also to prevent rain and the like from penetrating the enclosure along the vertical side edges of the panels 120. To further enhance the weather proofing, self adhesive strip gaskets may be used between the seam covers 139 and the panels 120. As shown in FIG. 2, the seam covers 134 overlap at 135 to ensure that water does not leak into the interior of the enclosure 10. Also as shown in FIG. 2, the panel 120 may preferrably be provided with an overlap 138 with the adjacent panel. A detent and matching groove can be formed in the overlapping parts of the panels 120 as shown in FIG. 12. This ensures that water cannot easily flow to the interior of the building along the horizontal edges of the panels 120. The panels 120 preferrably made from impact resistant polycarbonate plastic ultra/violet stablized. The panels 120 preferrably measure 48 in. wide, 92.75 in. long and 3.00 in. in depth. This configuration is in essence a two wall system with 13 corrugated flanges within. Wall thickness at any given point is preferrably 65/1000 in. Clear polycarbonate is preferrable to allow maximum radiation and light penetration. In summary the panels 120 ensure a rigid yet clear load bearing wall and roof skin for the structure. In addition the smooth external surface prevents snow or the like from accummulating thereon.

Once the plastic panels 120 have been laid in place on the girder assembly the seam covers 134 are placed over bolts 42 protruding from the girders. The seam covers 134 are preferrably made from metal and measure 8 in. width, 6 ft. length, and .083 in. thickness. At specified points special seam covers are used that allow the lifting points 56 to pass through the covers 134.

Figures 9, 10:
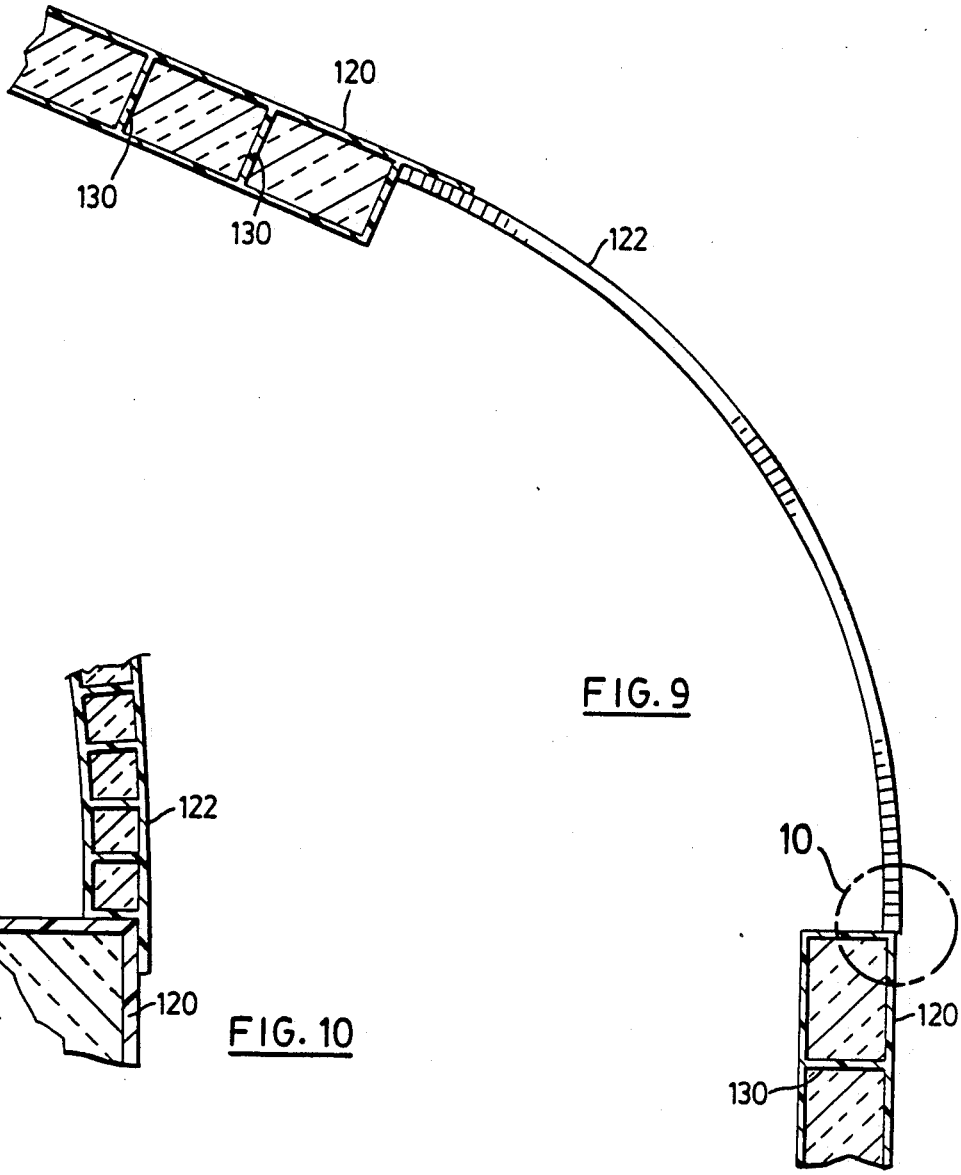
FIG. 9 is a detail view of the area denoted as 9 in FIG. 1.
FIG. 10 i a detail view of the area denoted as 10 in FIG. 9.

The eave panels 122 are somewhat similar in construction to the panels 120 although the eave panels 122 are much thinner and much more flexible. The eave panels 122 fit snuggly against the curved plate 60 and are held in place again by nuts and washers on the studs 42. FIG. 9 illustrates a roof panel 120, a eave panel 122 joining a wall panel 120. FIG. 10 illustrates the connection between the eave panel 122 and the wall panel 120. In this manner water is kept to the outside of the building enclosure 10.

The building panels 120 are formed from rigid polycarbonate plastic, and are preferrably clear. By means of the stiffening corrugations 130 the panels act as structural members in addition to allowing light to penetrate into the interior of the building enclosure. The panels are sufficiently strong that they can withstand typical snow and wind loads. In addition, the panels are secured between adjacent frame members providing rigidity to the overall structure 10.

The lifting points 56 can now be explained. Once the building 10 is completely assembled, it encloses a building site for the purpose of allowing construction to take place therein. Heat by way of sunlight is admitted to the enclosure while inclement weather is substantially restricted from entering. In addition, the enclosure can be lifted by the lifting points 56 from place to place to provide a readily removable protection against inclement weather. Such lifting could be effected for example by an overhead crane or the like and by attaching cables to the lifting eaves 56 to elevate the structure, intact, to the next site.

In some circumstances, it may be necessary to anchor the structure to the ground while construction or the like is taking place. This would be necessary in the case of strong winds for example. To accomplish this anchoring, guide wires could be connected to the internal frame or skeleton 14 of the structure 10 and anchored to the foundation being worked upon or anchored by means of concrete blocks or the like. This tying of the building enclosure to the ground of course would be detachable in order that the enclosure could be moved from place to place. Alternatively, a whalin 135 (shown in FIG. 1) could be bolted around the lower inside perimeter of the frame. The whalin would preferrably consist of a channel member or pipe, which could then be used as an attachment point for the anchoring wires. In addition to providing an attachment point, the whalin provides additional rigidity to the lower part of the frame to help maintain the columns 19 at the proper spacing.

Figure 11:
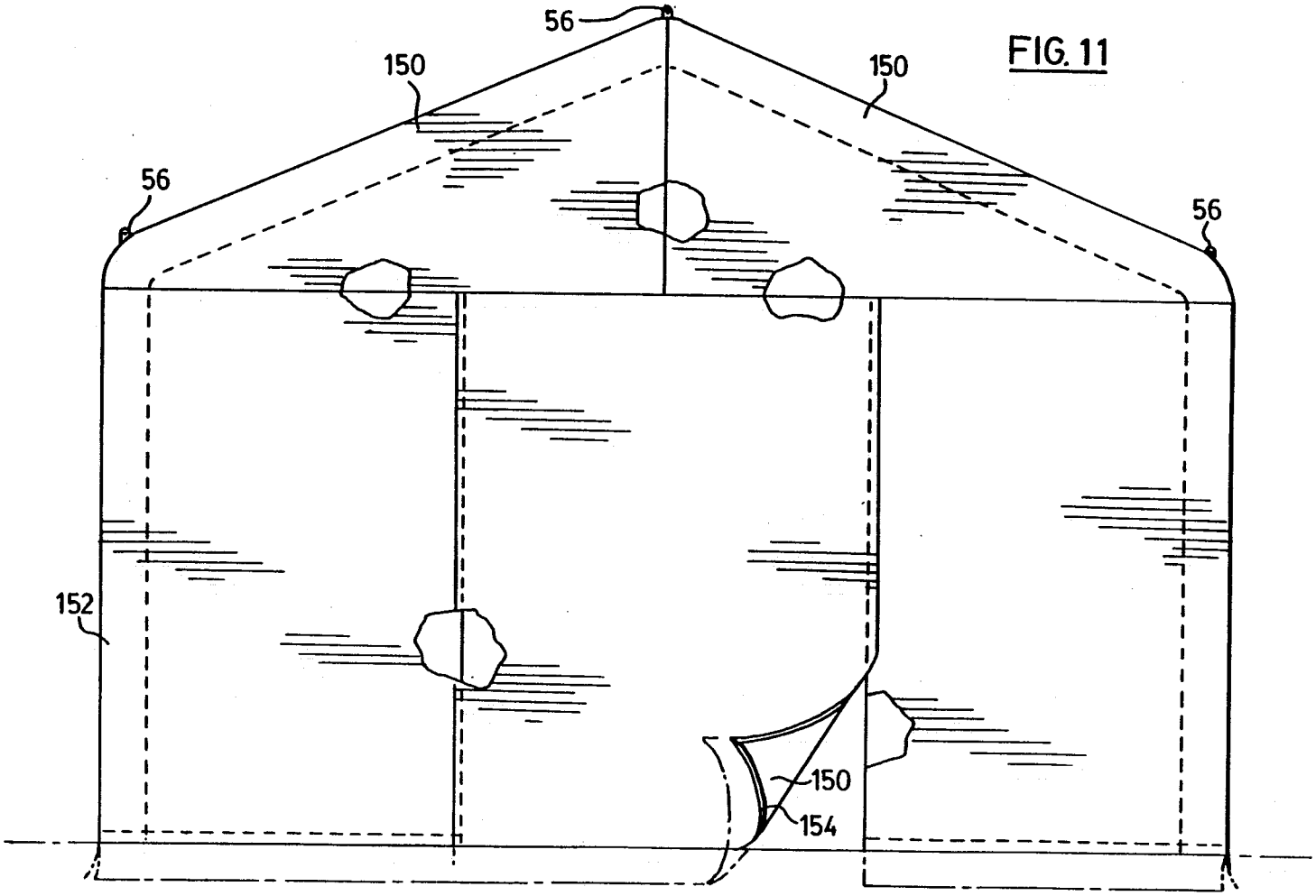
FIG. 11 is an end view of the enclosure of FIG. 1.

The roof and side walls of the invention are covered with the panels 120, 122 as previously described. However, in order to allow access to the building site of heavy equipment and the like, the ends of the building enclosure are formed from removable tarpaulins 150. Such tarpaulins may attached by means of VELCRO, in the configuration shown in FIG. 11. In this manner the end walls can be removed to allow access to the interior of the enclosure of heavy machinery for whatever lifting or other working is required and then the end walls can be replaced again upon completion of that phase of the work requiring the heavy machinery.

Figure 13:
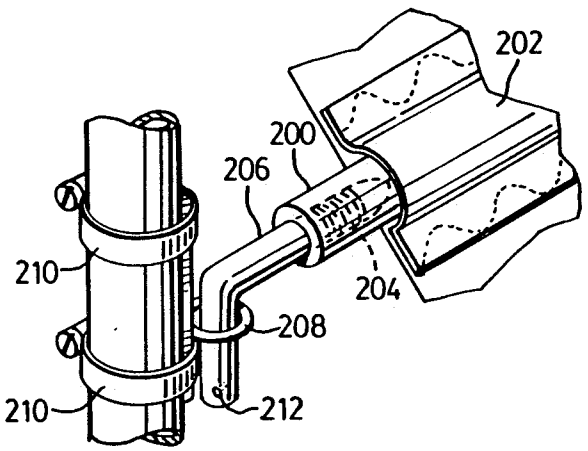
FIG. 13 shows a method of attaching tarpaulins to the end of the building enclosure.

Instead of VELCRO, other ways of attaching the tarpaulins may also be used. For example, as shown in FIG. 13, $\frac{3}{4}$ inch steel pipe 200 could be inserted into sleeves 202 formed into the tarpaulins. The steel pipe 200 would have threaded ends 204 into which L-shaped members 206 would be screwed. An eyelet member 208 could be attached to the appropriate portion of the end frameword, either by strap clamps 210, as shown, or by any other suitable means such as welding or the like. A hole 212 would be formed in the L-shaped member 206, into which a locking pin (not shown) could be inserted. A number of pipes 200 could be used for each tarpaulin given an openable end wall.

Each end of the enclosure 10 is preferrably made up of 6 sections of tarpaulin 150, which are preferrably made from 20 oz. vinyl. The tarpaulin sections have a sewn in nylon webbing 152 around all edges as well as a reinforcing strip sewn across the centre of the vertical sections.

It can now be appreciated how the foregoing structure may be quickly and easily combined to form a weather resistant building enclosure with the minimum of time and labour expense. In the preferred method of assembly, the first step is to lay out the elements of the roof framework in their relative positions prior to beginning assembly. The next step is to begin the assembly process by connecting the various elements together which form the ridge line of the structure. Specifically, two ridge elements 64 would be connected by means of an element 17.

The next step is to begin to assemble the elements 16 which form the main roof girders. On each side of each ridge element 62 a panel supporting element 16 is attached. The method of attachment involves aligning the locking holes of the male elements 44 with the locking holes of a female elements 46 in order that pins 76 may be inserted. Once elements 16 are attached to each of the ridge elements 62 a free standing roof peak section has been completed. Then, additional elements 17 can be added incorporating additional ridge elements 62 and additional elements 16. In this manner, the ridge can be extended to the desired length.

The next step is to complete the roof which may be done by connecting an appropriate number of elements 16 onto the free ends of the already connected elements 16. Because the connected ridge assembly is sitting on the ground, the first element 16 of each roof girder assembly is only pinned to the upper most male locking element at the ground level of the girders 21 leading from the free standing ridge assembly. Subsequent elements 16 forming the roof width can be pinned both at the upper and lower points. In order to maintain the correct distance between the girder assemblies formed from the elements 16, a wind brace crossing 84 may be installed between each pair of opposed elements 16. Once the desired roof width is achieved, an eave joint 50 is attached to all of the free ends.

Once all the girder assemblies 21 are extended to the correct length, the entire ridge structure is then lifted vertically. This may be accomplished either by a crane, attached to the lifting ears 56 of the ridge elements 62 or alternatively by jacking on the underside of the elements 17 which form the ridge. Once the ridge has been lifted an appropriate amount, the lower pin of the first element 16 of each girder assembly 21 can be inserted and locked in place. This is possible because the girder assemblies are free to rotate about the upper pin inserted into each first element 16 extending from the ridge joint 62.

The next step in the assembly process is to cover the roof. The covering procedure consists of placing the panels 120 on the right angle legs 26, 28 of the elements 16. Each panel is interlocked with the adjacent panel by means of the male/female detent as illustrated in FIG. 12. The roof is completely covered with panels and then the seam covers 134 are secured in place along the side edges of the panels 120. At this point, the roof assembly has been completed, and the structure is now ready for the wall assembly.

There are two methods by which the side walls 83 may be assembled. The choice of the method of assembly is dictated by the amount of space available at the erection site In the first method of the assembly of the walls 83, to be used where the assembly site has adequate room to accommodate the width of the roof plus the walls 83 assembled in their entirety and extended out at right angles to the existing roof structure, the procedure is similar to adding the elements 16 to form the girders 21 of the roof assembly. The columns 19 which form the walls 83 are connected from elements 16 one to another until the desired wall height is achieved. Again, the first element 16 in each wall column 19 is half connected to the eave joint 62 in the same manner as previously described. At this point, the entire roof has been lifted or raised sufficiently to provide room for the first girder to be partially connected. Once all of the wall column assemblies 19 have been connected, again crossed wind bracing 84 is installed between each column 19 to ensure the proper separation. Then, the panels 120 are installed on the walls using the same procedure as used with respect to the roof.

The final step in this method is to raise the entire structure until the locking holes of the unconnected female element 96 of the first element 16 of each wall column 19 is aligned with the male locking element 44 on the eave joints 62. Once alignment has been achieved, a pin 76 is inserted and the walls are fuly erected. Then, the structure 10 can be lowered to the ground and appropriate levelling can take place as required.

The alternate method of assembly would be appropriate where the site does not have enough room to fully extend the walls laterally out from the roof structure. In this method, the wall column assemblies are created one element 16 at a time while the roof is gradually lifted vertically. For example, the roof assembly is raised and a single element 16 is attached to each ridge element 62. Wind cross bracing 84 is installed and then the sections are paneled with the panels 120. Then, the assembly is raised up and a second element 16 is attached from the lower free end of the first element 16. Again, panels are attached and the assembly process continues until a desired wall height is achieved. Upon achieving the desired wall height, the assembly is lowered to the ground, levelled, and anchored.

It will be appreciated, that the present enclosure does not provide a completely air tight or weather proof installation. However, the purpose is merely to reduce the effects of severe weather on a site to be worked. In addition, it is desired to have modular components which can be assembled to any desired height, length or width. In the instant case, very few types of building elements are required as compared to the overall number of individual elements required which facilitates both the assembly of the elements and the assembly of the building enclosures.

I claim:

1. A weather resistant building enclosure comprising:

(a) an internal rigid load supporting framework comprising a plurality of columns, roof girders supported by said columns, and beams extending between and adjacent to said columns and said roof girders;

(b) an external load supporting surface comprised of a plurality of rigid transparent building panels, each panel having an inner layer, an outer layer and a plurality of stiffening webs running between said inner and outer layers, said panels transmitting solar light and heat into said building enclosure, each panel having two side edges, a lower edge and an upper edge, said penal having a width greater than its height and being supported by said rigid framework along its side edges and further having an opening in said lower edge to flexibly retain the next adjacent lower panel therein; and (c) a plurality of joint elements, said joint elements being located at the roof peak and along the eaves, to join the columns to the girders and to join the girders to girders on the opposite roof face, said joint elements including eave joint elements said each joint elements comprising inner and outer generally parallel bent tubular elements, a plurality of cross braces fixed therebetween, a flat bar running generally vertical between said cross braces, and male and female attachement members at either end of said generally tubular elements.

2. The building enclosure of claim 1 wherein the columns, roof girders and beams are formed from a plurality of elements, each element having a pair of opposed tubular members with at least one cross brace and at least one angle brace running therebetween, each element having demountable end attachments whereby the elements may be releasably secured together to form said internal rigid load supporting framework.

3. The building enclosure of claim 2 wherein the element forming said columns and said roof girders further comprises a pair of opposed right angle channels affixed to the outer of said opposed tubular members, for carrying said building panels therein, a plurality of outwardly extending threaded studs, along said outer of said tubular members, and each of said tubular members has affixed at one end male attachment members, and at the other end female attachment members.

4. The building enclosure of claim 3 further including a plurality of seam covers, said seam covers being releasably secured on said threaded studs, said plurality of building panels being secured between said seam covers and said channels and thereby forming a secure outer skin on said enclosure.

5. The building enclosure of claim 1 wherein said eave joint element further includes a plurality of threaded outwardly extending studs, and a bent plate, fixed to the outer of said generally parallel tubular elements.

6. The building enclosure of claim 1 wherein said joint elements include ridge joint elements, said ridge joint elements comprising a generally vertically oriented flat bar, having opposed upper bent arms and opposed lower arms, and a brace running between said upper and lower arms, said flat bar having a plurality of locking holes therein.

7. The building enclosure of claim 6 wherein said ridge joint element includes a lifting point.

8. The building enclosure of claim 6 further including a ridge cover, said ridge cover being releasably secured to said threaded studs.

9. The building enclosure of claim 1 wherein said eave joint element includes a lifting point.

10. The building enclosure of claim 1 further comprising flexible releasably secured end walls.

11. The building enclosure of claim 1 wherein said internal rigid load supporting framework is comprised of a number of elements, and said elements are secured together by a plurality of clips.

12. The building enclosure of claim 11 wherein said clips comprise a pin having grooves adjacent either end, and lock rings which may be releasably secured in said grooves of said slips.

13. A panel supporting element for use in a weather resistant building enclosure as claimed in claim 1, said panel supporting element comprising, upper and lower bars connected in a fixed, parallel position by cross braces and angle braces, a pair of opposed channels attached to either side of said upper bar, said bars further having male and female attaching members located at either end, and said upper bar having a plurality of threaded studs extending upwardly from an upper outer surface of said upper bar.

14. A panel supporting element as claimed in claim 13 wherein said male attaching members are affixed to one end of said upper and lower bars and said female attaching members are affixed to the opposite ends of said upper and lower bars.

15. A corner or eave joint member for using a weather resistant building enclosure as claimed in claim 1, said eave joint member comprising, an inner and an outer bent bar, said bars arranged such that the distance between them is substantially constant through a bend, a plurality of cross-braces affixed between said inner and outer bars, a flat bar affixed between said outer bent bar and at least two of said cross-braces, a curved plate attached to the outer most portion of the outer bent bar, said curved plate being disposed at right angles to said cross braces, and male and female attaching members located at either end of said inner and outer bent bars.

16. A corner or eave joint member as in claim 15 having threaded studs attached to said curved plate, said threaded studs extending perpendicularily outward from said curved plate.

17. A corner or eave joint member as in claim 16 wherein said male attaching members are affixed to adjacent ends of said inner and outer bent bars and said female attaching members are located on the opposite ends of said inner and outer bent bars.

18. A corner or eave joint member as in claim 17 having a lifting point extending from the outer surface of said curved plate.

19. A corner or eave joint member as in claim 18 wherein said flat bar has a plurality of locking holes therein.

20. A ridge joint member for use in a weather resistant building enclosure as claimed in claim 1, said ridge joint member comprising a central vertically oriented flat bar, a pair of upper arms extending radially outward from opposing sides of an upper portion of said flat bar, a pair of lower arms extending radially outward from opposing sides of a lower portion of said bar, said upper and lower arms each having male attaching members on their ends distant from said flat bar.

21. A ridge joint member as in claim 20 wherein said upper arms having threaded studs attached to their upper surfaces, aid threaded studs being approximately parallels to said flat bar.

22. A ridge joint member as in claim 21 wherein said central vertically oriented flat bar includes a lifting point.

23. A ridge joint member as in claim 22 having angle braces extending between said upper and said lower arm.

24. A ridge joint member as in claim 24 wherein said flat bar has a plurality of locking holes therein.

* * * * *